US006783661B1

(12) United States Patent
Briot et al.

(10) Patent No.: US 6,783,661 B1
(45) Date of Patent: Aug. 31, 2004

(54) PROCESS FOR PRODUCING OILS WITH A HIGH VISCOSITY INDEX

(75) Inventors: Patrick Briot, Pommier de Beaurepaire (FR); Christophe Gueret, St Roman en Gal (FR); Jean-Claude Hipeaux, Colombes (FR); Eric Benazzi, Chatou (FR); Pierre Marion, Sceau (FR); Alain Billon, Le Vesinet (FR)

(73) Assignee: Institut Francais du Petrole, Ruiel-Malmaison Cedex (FR)

( * ) Notice: Subject to any disclaimer, the term of this patent is extended or adjusted under 35 U.S.C. 154(b) by 74 days.

(21) Appl. No.: 09/644,605

(22) Filed: Aug. 24, 2000

(30) Foreign Application Priority Data

Aug. 24, 1999 (FR) ..... 99 10769

(51) Int. Cl.[7] ..... C01G 47/02; C01G 65/02

(52) U.S. Cl. ..... 208/95; 208/58; 208/59; 208/111.01; 208/111.3; 208/111.35

(58) Field of Search ..... 208/58, 59, 95, 208/111.01, 111.3, 111.35

(56) References Cited

U.S. PATENT DOCUMENTS 3,507,786 A 4/1970 Walker et al. ..... 208/308
4,457,830 A * 7/1984 Kydd ..... 208/50
4,975,177 A 12/1990 Garwood et al. ..... 208/27
5,306,860 A * 4/1994 Bigeard et al. ..... 535/737
5,525,209 A * 6/1996 Billon ..... 208/59
5,911,874 A * 6/1999 Cody et al. ..... 208/87
5,935,416 A * 8/1999 Cody et al. ..... 208/87
5,976,353 A * 11/1999 Cody et al. ..... 208/87

FOREIGN PATENT DOCUMENTS

FR 2 600 669 12/1987
WO WO 97/18278 5/1997

* cited by examiner

*Primary Examiner*—Walter D. Griffin
(74) *Attorney, Agent, or Firm*—Millen White Zelano & Branigan, P.C.

(57) ABSTRACT

A process for producing oils with high viscosity indices from oil distillates or effluents from a conversion unit comprises the following steps:

Figure 1:
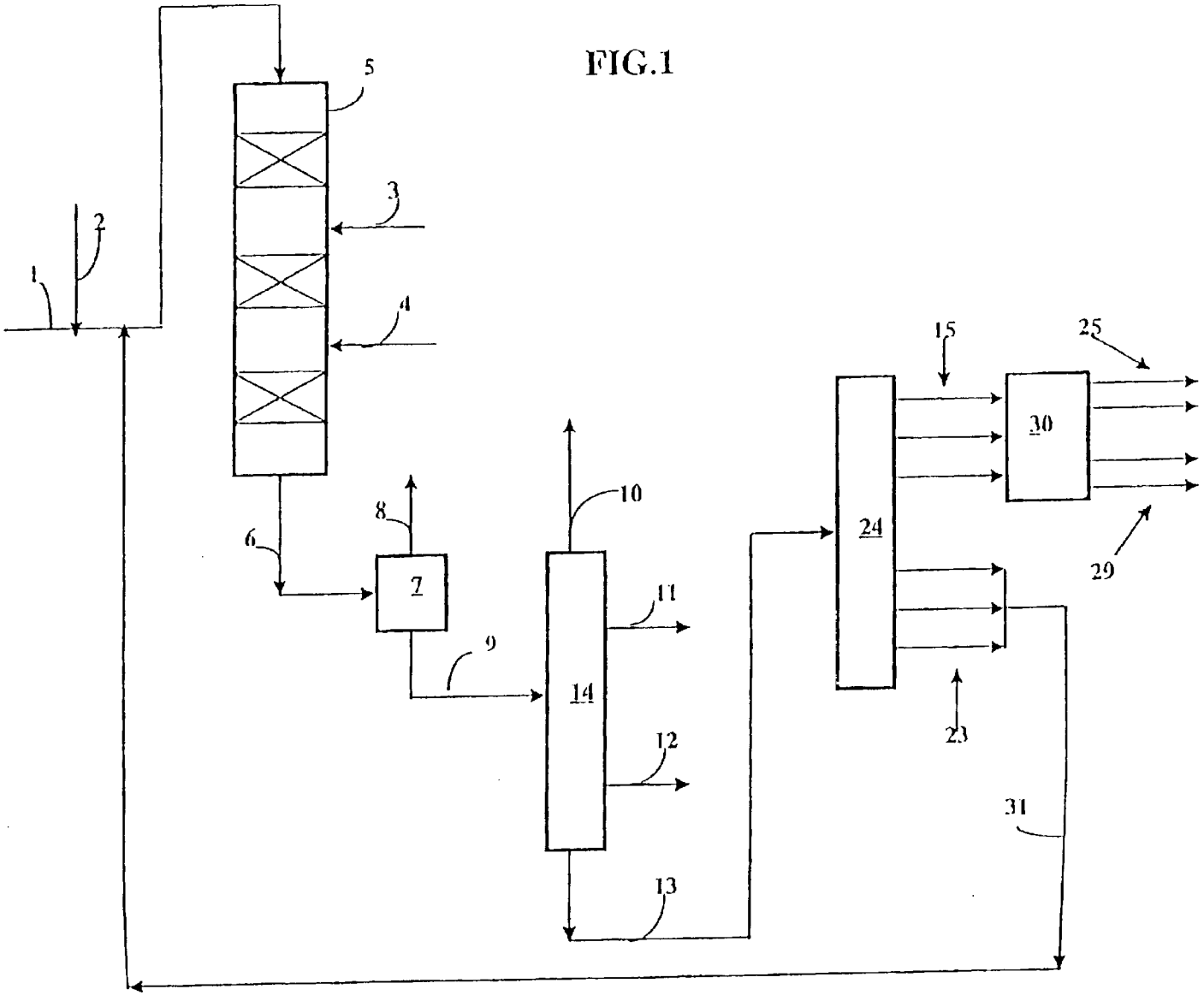

a) catalytic hydrotreatment of the feed in the presence of hydrogen and a non zeolitic catalyst;

b) fractionation of at least a portion of the effluent from step a) or step d) described below to an oil residue;

c) fractionation by thermal diffusion of at least a portion of the oil residue obtained from step b) into oil fractions with different compositions and viscosity indices.

Step b) can be preceded by a step d) for hydrocracking the effluent obtained from step a) in the presence of hydrogen and a zeolitic catalyst.

20 Claims, 4 Drawing Sheets

PROCESS FOR PRODUCING OILS WITH A HIGH VISCOSITY INDEX

The present invention relates to a process for producing oils with high viscosity indices, more particularly oils with a viscosity index of more than about 100, from a feed containing constituents with boiling points of more than 300° C. The process is a sequence of operations enabling an oily residue to be recovered part of which is fractionated by thermal diffusion into different oils with different compositions and viscosity indices.

High performance engines require oils with ever higher viscosity indices. Specifications for indices are presently in the range 95 to 100.

International patent WO-A-97/18278 describes a process for producing a dewaxed lubricating oil, comprising at least one hydrocracking zone, at least one dewaxing zone and at least one hydrorefining zone. The hydrocarbon feed comprises gas oils from a first vacuum distillation, deasphalted raffinates or a mixture of two of such cuts. Cracked feeds can also be added to the initial feed but in quantities not exceeding 20% due to their high aromatics content and low hydrogen content.

U.S. Pat. No. 4,975,177 describes a process in three successive steps for producing a lubricant with a viscosity index of at least 130 and with a pour point of less than 5° F. (−15° C.), comprising a step for dewaxing a petroleum feed to form a paraffin-rich feed containing at least 50% by weight of paraffin and with a boiling point of more than 650° F. (343° C.), a step for catalytic dewaxing by isomerisation of the effluent obtained from step a) at high pressure in the presence of hydrogen and a catalyst containing a beta zeolite and a hydrodehydrogenating function, to isomerise the n-paraffins to iso-paraffins, and a selective dewaxing step in the presence of a catalyst based on zeolite with a constraint index of at least 8. The presence of hydrogen in the second step enables the activity of the catalyst to be maintained and encourages the different steps of the isomerisation mechanism. Isomerisation then entrains hydrogenation and dehydrogenation of the dewaxed feed.

The Applicant's French patent FR-A-2 600 669 describes a process for hydrocracking in three successive steps for the production of middle distillates (gasoline, kerosine, gas oil), which enables fractions to be recovered in accordance with their boiling points. Fractions with boiling points of less than 375° C. are recovered and those with boiling points of more than 375° C. are recycled. The present application is based on recovering oily fractions in accordance with their viscosity indices. Further, it can recover not only middle distillates but also a column bottoms product essentially containing oils with different compositions and viscosity indices.

The invention concerns the production of oils with high viscosity indices, preferably more than about 100, and more preferably more than about 140, by direct treatment of petroleum fractions. One advantage of the invention is the production of oils with different compositions. The refiner has the choice between recovering the oils or recycling them depending on the limiting viscosity index which has been fixed by him.

More particularly, the invention concerns a process for producing oils with a high viscosity index and is applicable to a feed containing constituents with boiling points of more than 300° C.

The feeds used in the present invention are petroleum fractions with a boiling point of more than 300° C., normally in the range about 300° C. to 650° C., preferably in the range about 350° C. to 550° C. These feeds are of a variety of origins. Non limiting examples of said feeds are those originating either from crude oil distillates or from effluents from conversion units, such as fluidised bed catalytic cracking units, hydrocracking or ebullated bed hydrotreatment.

These feeds principally contain aromatic, naphthenic and paraffinic compounds. They are characterized by defined kinematic viscosities defined using standards at 40° C. and 100° C. The kinematic viscosity at 40° C. is normally in the range about 40 to 500 square millimetres per second ($mm^2/s$), usually in the range about 40 to 300 $mm^2/s$, and the kinematic viscosity at 100° C. is generally in the range about 2 to 40 $mm^2/s$, usually in the range about 5 to 15 $mm^2/s$. The density of the feeds is normally in the range about 0.89 to 0.98, usually in the range about 0.91 to 0.97, at 15° C.

The process of the invention is a process for producing oils with a high viscosity index from a feed containing constituents with boiling points of more than 300° C. It comprises a step a) in which hydrogen is reacted with the feed or with a mixture of the feed with at least a fraction of a recycle stream from step c), in the presence of a catalyst comprising at least one amorphous non zeolitic matrix and at least one metal or compound of a metal from group VIII of the periodic table and/or at least one metal from group VIB, a step b) in which at least a portion of the effluent obtained from step a) is fractionated so as to separate at least one oil residue mainly comprising constituents with viscosity indices which are higher than that of the feed, and a step c) in which at least a portion of the oil residue obtained in step b) is fractionated by thermal diffusion into oil fractions with high viscosity indices. Said process can separate oils in accordance with their viscosity index.

In step a), the feed is converted into at least one effluent containing mainly kerosine, gasoline, gas oil and oils.

The catalyst for the first step can be in the form of beads, but it is usually in the form of extrudates. The hydrodehydrogenating function of said catalyst is ensured by the metal or compound of a metal selected from the group formed by metals from group VIII of the periodic table (in particular nickel and cobalt), and metals from group VIB (in particular molybdenum and tungsten). It is also possible to associate at least one metal from group VIII (nickel and/or cobalt) with at least one metal from group VIB (molybdenum and/or tungsten).

The total concentration of group VIII and VIB elements is expressed as the concentration of metal oxides. The concentration of group VIII metal oxides is normally in the range about 0.5% to 10% by weight, preferably in the range about 1% to 7% by weight. The concentration of group VIB metal oxides is normally in the range about 1% to about 30% by weight, preferably in the range about 5% to 20% by weight. The total concentration of group VIB and VIII metal oxides is normally in the range about 5% to 40% by weight, usually in the range about 7% to 30% by weight.

The ratio between the group VI metal (or metals) and the group VIII metal (or metals), expressed as the metal oxides, is generally about 20 to 1 by weight, usually about 10 to 2.

The matrix for the catalyst of step a) is normally selected from the group formed by alumina, silica, silica-aluminas, magnesia, clays and mixtures of at least two of these minerals. Preferably, a $\gamma$ or $\eta$ alumina is used. The matrix can also contain oxides selected from the group formed by boron oxide, zirconia, titanium oxide and phosphorous pentoxide. The matrix is usually doped with phosphorous and possibly with boron. The presence of phosphorous in the catalyst firstly facilitates its preparation, in particular when impregnating nickel and molybdenum solutions, and secondly improves the acidity and hydrogenation activity of the catalyst. The concentration of phosphorous pentoxide $P_2O_5$ is normally less than about 20% by weight, usually less than about 10% and more preferably less than about 1% by weight. The concentration of boron trioxide $B_2O_3$ is normally less than about 10% by weight.

The hydrogen used in step a) of the process of the invention essentially acts to hydrogenate the aromatic compounds contained in the feed.

The catalyst for step a) encourages hydrogenation over cracking. It can open naphthenic rings and enables hydrogenation of aromatic compounds, to reduce the amount of condensed polycyclic aromatic hydrocarbons. This reduction results in a drop in the density of the effluent and in an increase in the paraffinic carbon content and in its viscosity index. Further, the majority of the nitrogen-containing compounds contained in the feed are also transformed. The catalyst for step a) can encourage transformation of the sulphur-containing compounds to hydrogen sulphide and nitrogen-containing compounds to ammonia. Conversion of the feed remains limited. It is usually less than or equal to about 50% by weight in step a) of the process of the invention.

The effluent obtained in step a) can be fractionated into at least one gaseous effluent and into at least one liquid effluent in at least one separator. The gaseous effluent principally contains hydrogen sulphide, ammonia and light hydrocarbons containing 1 to 4 carbon atoms. Usually, separation necessitates a high pressure separator to eliminate the gaseous effluent which is evacuated. The light hydrocarbons which are recovered can be used in a fuel gas system.

Step a) can be followed by a hydrocracking step d), which brings at least a portion of the total effluent obtained from step a) or a portion of the liquid effluent obtained after fractionation into contact with hydrogen, in the presence of a catalyst comprising at least one zeolite, at least one matrix, and at least one metal or compound of a metal from group VIII of the periodic table and/or at least one group VIB metal, said metal having a hydrodehydrogenating function. This step d) can improve the viscosity index of the oil residue with respect to that obtained in the absence of step d). Step d) is carried out when the refiner wishes to produce very high viscosity indices.

Fractionation can be envisaged for the effluent from step d). The separation procedure is identical to that carried out for the effluent obtained from step a). The effluent obtained from step d) can thus be fractionated into at least one gaseous effluent and at least one liquid effluent. In general, the fractionation can be carried out at the outlet from step a), and/or at the outlet from step d). Preferably, fractionation takes place at the outlet from step d) or at the outlet from step a) when step d) is not carried out.

The zeolite for the catalyst of step d) is usually an acid zeolite HY characterized by the following specifications: a $SiO_2/Al_2O_3$ mole ratio which is normally in the range about 8 to 70, preferably in the range about 12 to 40; a sodium content which is generally less than about 0.15% by weight, determined on the zeolite calcined at 1100° C.; a lattice parameter $\alpha$ of the unit cell normally in the range about $24.55\times10^{-10}$ metres (m) to 24.24 $10^{-10}$ m, preferably in the range about $24.38\times10^{-10}$ m to $24.26\times10^{-10}$ m; a sodium ion take-up capacity $C_{Na}$, expressed in grams (g) of sodium per 100 g of modified zeolite, neutralised then calcined, generally more than about 0.85; a specific surface area, determined by the BET method, normally more than about 400 $m^2/g$ (square metres per gram), preferably more than about 550 $m^2/g$; a water vapour adsorption capacity at 25° C. at a partial pressure of 2.6 torrs (i.e., 346.63 Pa) generally more than about 6% by weight, a pore distribution normally comprising in the range about 1% to 20%, preferably in the range about 3% to 15% of the pore volume contained in pores with a diameter located between about $20\times10^{-10}$ metres and $80\times10^{-10}$ metres, the remainder of the pore volume being contained in pores with a diameter of less than $20\times10^{-10}$ metres.

The zeolite can optionally be doped with metallic elements such as metals from the rare earth family, in particular lanthanum and cerium, or noble or non noble metals from group VIII of the periodic table, such as platinum, palladium, ruthenium, rhodium, iridium, iron and other metals such as manganese, zinc or magnesium.

The zeolite content is normally in the range about 2% to 80% by weight, preferably in the range about 3% to 50% by weight with respect to the final catalyst used in step d).

The matrix of the catalyst for step d) is a support selected from the group formed by alumina, silica, silica-alumina, alumina-boron oxide, magnesia, silica-magnesia, zirconia, titanium oxide, clay, and these compounds being used alone or as a mixture. Preferably, an alumina support is used.

The hydrodehydrogenating function is ensured by a combination of metals from groups VIB (in particular molybdenum and/or tungsten), and VIII (in particular cobalt and/or nickel) of the periodic table. The catalyst can advantageously contain phosphorous, for the reasons cited above regarding the catalyst for step a).

The total concentration of oxides of groups VIB and VIII metals is normally in the range about 1% to 40% by weight, preferably in the range about 3% to 30% by weight. The ratio between the group VI metal (or metals) and the group VIII metal (or metals), expressed as the metal oxides, is generally in the range about 20 to 1.25 by weight, preferably in the range about 10 to 2. The concentration of phosphorous oxides is normally less than about 15% by weight, preferably less than about 10% by weight.

The zeolite-based catalyst for step d) is more active than the catalyst for step a). Thus the degree of conversion for step d) is higher than that for the first step. The percentage of aromatic carbons is reduced and the percentage of paraffinic carbon increases, which has the effect of improving the viscosity index of the effluent from step d) with respect to that obtained in step a). The catalyst for step d) is much more sensitive to poisons than that for the first step. It operates solely with recycled streams, on total effluents from step a) or on liquid effluents from fractionation of the products leaving step a).

It is possible to recycle at least a portion of the unconverted fractions recovered front step a) or d). The boiling points of said fractions are identical to those of the feed but the chemical properties are different. Recycling is carried out either to step a) or to step d) or partially to both these two steps.

Step b) of the process of the invention is a step for fractionation of at least a portion of the effluent from step a) or step d), to separate at least one oil residue mainly containing constituents with higher viscosity indices than that of the feed. Fractionation is preferably by distillation.

Step c) of the process of the invention is a step for thermal diffusion fractionation of at least a portion of the oil residue obtained from step b) into oil fractions with high viscosity indices, preferably more than about 100 and more platinum more than about 140. The oils are separated in accordance with their viscosity index, i.e., in accordance with their composition of aromatic carbons, naphthenic carbons and paraffinic carbons.

Depending on the viscosity index of the fractions obtained in step c), said fractions are either recycled or recovered. The choice between recycling or recovering these fractions is left to the refiner. In particular, fractions with a viscosity index of more than about 140 are recovered. These fractions are rich in paraffinic carbons. The fractions for which the viscosity index is low, preferably less than about 100, constitute the streams for recycling for step c). This recycling is carried out either to step a) or to step d), or partially to both steps. These fractions are generally rich in aromatic carbons and depleted in paraffinic carbons.

When dewaxing is carried out catalytically, catalysts comprising at least one zeolite and at least one hydrodehydrogenating function can be used.

Preferably, the acid function is ensured by at least one molecular sieve the microporous system of which has at least one principal channel type with openings formed by rings containing 10 or 9 T atoms. T atoms are tetrahedral atoms constituting the molecular sieve and can be at least one of the elements contained in the following set of atoms: (Si, Al, P, B, Ti, Fe, Ga). In the constituent rings of the channel openings, T atoms as defined above alternate with an equal number of oxygen atoms. It can thus also be said that the openings are formed by rings containing 10 to 9 oxygen atoms or formed by rings containing 10 or 9 T atoms.

The molecular sieve used in the composition of the hydrodewaxing catalyst can also comprise other types of channels but in which the openings are formed by rings which contain less than 10 T atoms or oxygen atoms.

The molecular sieve used in the composition of the catalyst also has a bridging distance, the distance between two pore openings, as defined above, which is at most 0.75 nm (1 nm=$10^{-9}$), preferably in the range 0.50 nm to 0.75 nm, still more preferably in the range 0.52 nm to 0.73 nm.

The Applicant has discovered that one of the determining factors for producing good catalytic performances in the third step (hydrodewaxing step) is the use of molecular sieves with a bridging distance of at most 0.75 nm, preferably in the range 0.50 nm to 0.75 nm, more preferably in the range 0.52 nm to 0.73 nm.

The bridging distance is measured using a graphics tool and a molecular modelling tool such as Hyperchem or Biosym, which enables the surface of the molecular sieves under consideration to be constructed and, by taking into account the ionic radii of the elements present in the framework of the sieve, enables the bridging distance to be measured.

The catalyst which is suitable for this process is characterized by a catalytic test known as a standard pure n-decane transformation test which is carried out at a partial pressure of 450 kPa of hydrogen and at a partial n-$C_{10}$ pressure of 1.2 kPa, i.e., a total pressure of 51.2 kPa in a fixed bed with a constant n-$C_{10}$ flow rate of 9.5 ml/h, a total flow rate of 3.6 l/h and a catalyst mass of 0.2 g. The reaction is carried out in downflow mode. The degree of conversion is regulated by the temperature at which the reaction is carried out. The catalyst which undergoes said test is constituted by pure pelletised zeolite and 0.5% by weight of platinum.

In the presence of the molecular sieve and a hydrodehydrogenating function, the n-decane undergoes hydroisomerisation reactions which produce isomerised products containing 10 carbon atoms, and hydrocracking reactions leading to the formation of products containing less than 10 carbon atoms.

Under these conditions, a molecular sieve used in the hydrodewaxing step of the invention must have the physicochemical characteristics described above and lead, for a n-$C_{10}$ isomerised product yield of the order of 5% by weight (the degree of conversion is regulated by the temperature) to a 2-methylnonane/5-methylnonane ratio of more than 5 and preferably more than 7.

The use of the selected molecular sieves under the conditions described above from the many molecular sieves currently in existence enables the production of products with a low pour point and a high viscosity index with good yields in the process of the invention.

Examples of molecular sieves which can be used in the composition of the hydrodewaxing catalyst are the following zeolites: ferrierite, NU-10, EU-13, EU-1 and zeolites with the same structure type.

Preferably, the molecular sieves used in the composition of the hydrodewaxing catalyst composition are included in the set formed by ferrierite and EU-1 zeolite.

The weight content of the molecular sieve in the hydrodewaxing catalyst is in the range 1% to 90%, preferably in the range 5% to 90% and more preferably in the range 10% to 85%.

Non limiting examples of matrices used to form the catalyst are alumina gels, aluminas, magnesia, amorphous silica-aluminas, and mixtures thereof. Techniques such as extrusion, pelletisation, or granulation can be used to carry out the forming operation.

The catalyst also comprises a hydrodehydrogenating function ensured, for example, by at least one element from group VIII and preferably at least one element included in the group formed by platinum and palladium. The weight content of the non noble metal from group VIII with respect to the final catalyst is in the range 1% to 40%, preferably in the range 10% to 30%. In this case, the non noble metal is usually associated with at least one metal from group VIB (preferably Mo and W). If a noble group VIII metal is used, the weight content with respect to the final catalyst is less than 5%, preferably less than 3%, more preferably less than 1.5%.

In the case of using noble group VIII metals, the platinum and/or palladium are preferably localised on the matrix, defined as above.

The hydrodewaxing catalyst of the invention can also contain 0 to 20%, preferably 0 to 10% by weight (expressed as the oxides) of phosphorous. The combination of group VIB metal(s) to group VIII metal(s) with phosphorous is particularly advantageous.

Dewaxing can be carried out either on the oil residue before step c) for thermal diffusion fractionation, or on non recycled fractions extracted from step c). The dewaxing operation can employ a catalyst containing at least one zeolite or a solvent. The paraffins obtained after solvent dewaxing can be recycled either to step a) or to step d) or partially to both steps. Preferably, solvent dewaxing is carried out. Said solvent is heated with the product to be dewaxed then cooled and finally filtered, to remove heavy straight chain paraffins. Usually, methyl-ethyl-ketone or methyl-isobutyl-ketone is used as the solvent.

The operating conditions for step a) and step d) of the process of the invention can be identical or different. In these two steps, the absolute pressure is normally in the range about 2 to 35 MPa, preferably in the range about 5 to 25 MPa; the temperature is generally in the range about 300° C. to 550° C., preferably in the range 320° C. to 450° C.; the hourly space velocity is normally in the range about 0.01 to 10 $h^{-1}$, preferably in the range about 0.01 to 5 $h^{-1}$. These steps are carried out in the presence of hydrogen. The $H_2$/HC ratio is normally in the range about 50 to 5000 $Nm^3/m^3$, preferably in the range about 300 to 3000 $Nm^3/m^3$ (normal cubic metres/cubic metre, "normal" signifying normal pressure conditions of 0.1 MPa and a temperature of 25° C.).

Step c) of the process of the invention is carried out in at least one thermal diffusion column of a height which is normally in the range about 0.5 to 30 metres (m), preferably in the range about 0.5 to 20 m. The column comprises two tubes placed one inside the other. The space between the two tubes is generally in the range about 1 millimetre (mm) to 20 centimetres (cm). The temperature difference between the wall of the internal tube and the wall of the external tube is normally in the range about 25° C. to 300° C. The wall of the internal tube is kept at a lower temperature than that of the wall of the external tube. A thermal equilibrium is established between the two walls, such that from the top to the bottom of the column, paraffinic compounds (n and iso), monocylic compounds (mononaphthenes and monoaromatic compounds), bicyclic compounds and tricyclic compounds are recovered. FIGS. 1 to 4 show different implementations of the process of the invention.

In FIG. 1, the feed containing constituents with boiling points of more than about 300° C. is sent via line 1 to reactor 5 containing the hydrotreatment catalyst and hydrogen which arrives via lines 2, 3 and 4. Under the operating conditions described above, the feed is almost completely desulphurised and denitrogenated. It is converted into an effluent and its aromatic carbons percentage is reduced.

The effluent leaving via line 6 is sent to a high pressure separator 7 after prior injection of washing water via a line not shown in the figure. The washing water containing ammonia and a portion of the dissolved hydrogen sulphide is evacuated from the separator, via a line which is not shown in the figure. The gases from the separator 7 contain a large amount of hydrogen and are evacuated via line 8 after optional washing to eliminate hydrogen sulphide, via a line not shown in the figure. Said gases also contain light hydrocarbons containing 1 to 4 carbon atoms which are evacuated via line 8. Said hydrocarbons can then be used in the fuel-gas system, generally after separation with hydrogen.

The remaining liquid effluent is then directed towards a fractionation apparatus 14 via line 9. In this apparatus, a gasoline fraction which can be used as a catalytic reforming feed is extracted overhead via line 10, the kerosine fraction is extracted via line 11, the gas oil fraction is extracted via line 12 and an oil residue is extracted via line 13 which is sent to a thermal diffusion column 24.

The fractions are extracted from column 24 via lines 15 to 23. The fractions extracted via lines 15 to 19 are sent to a solvent dewaxing apparatus 30. The fractions from lines 25 to 29 have high viscosity indices. The bottom product from column 24 is recycled via line 31 to feed inlet line 1. The paraffins from dewaxing are recycled to the reactor via line 32.

Figure 2:
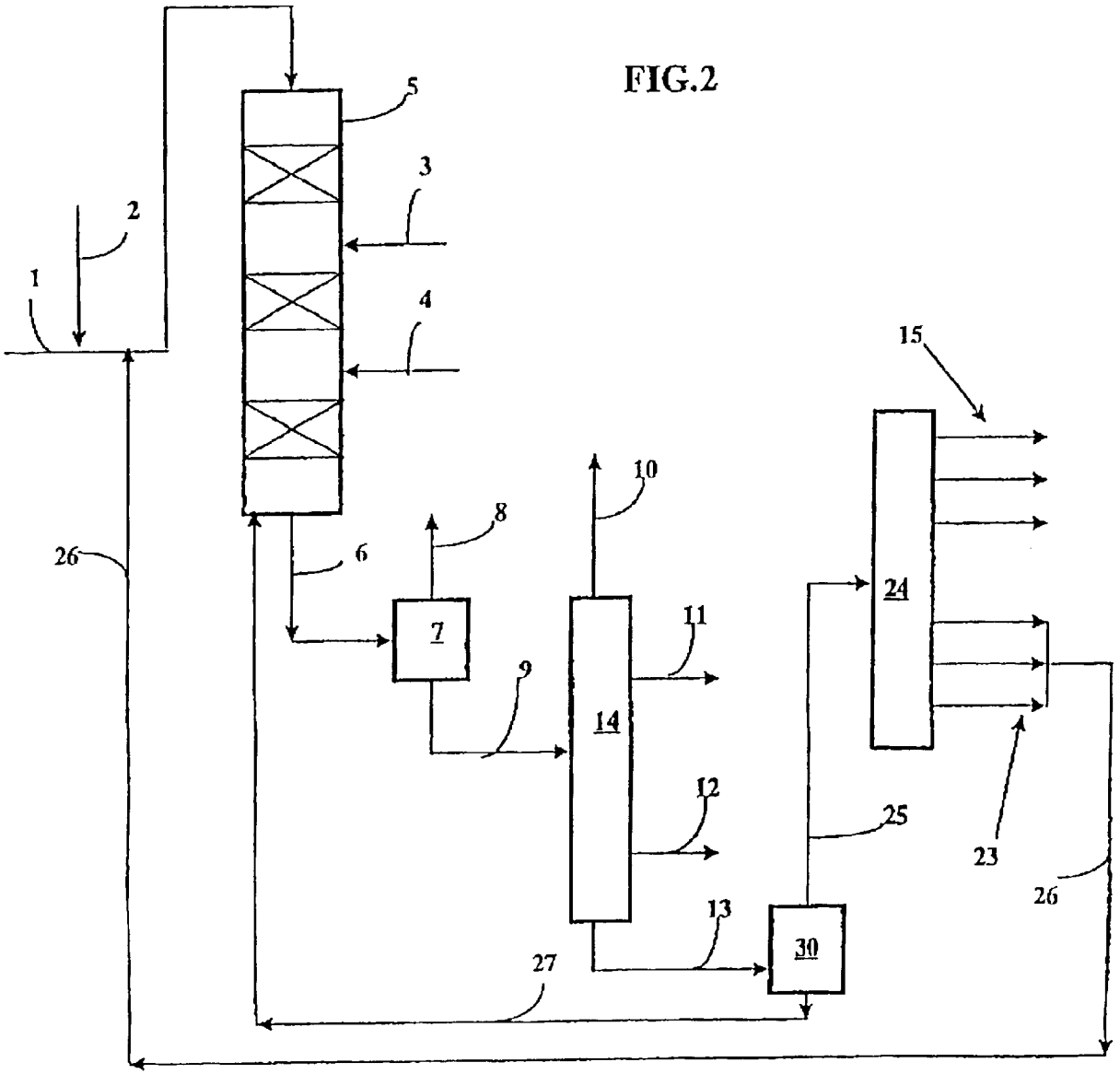

The implementation of FIG. 2 differs from that of FIG. 1 in that the dewaxing apparatus 30 is placed at the outlet from fractionation apparatus 14. The dewaxing operation is thus carried out on the oily residue. This dewaxed residue is then directed via line 25 to thermal diffusion column 24. The fractions are extracted via lines 15 to 23. The fractions from lines 15 to 19 are recovered, fractions 20 to 23 are recycled via line 26 to reactor 5. The paraffins from dewaxing are recycled to reactor 5 via line 27.

Figure 3:
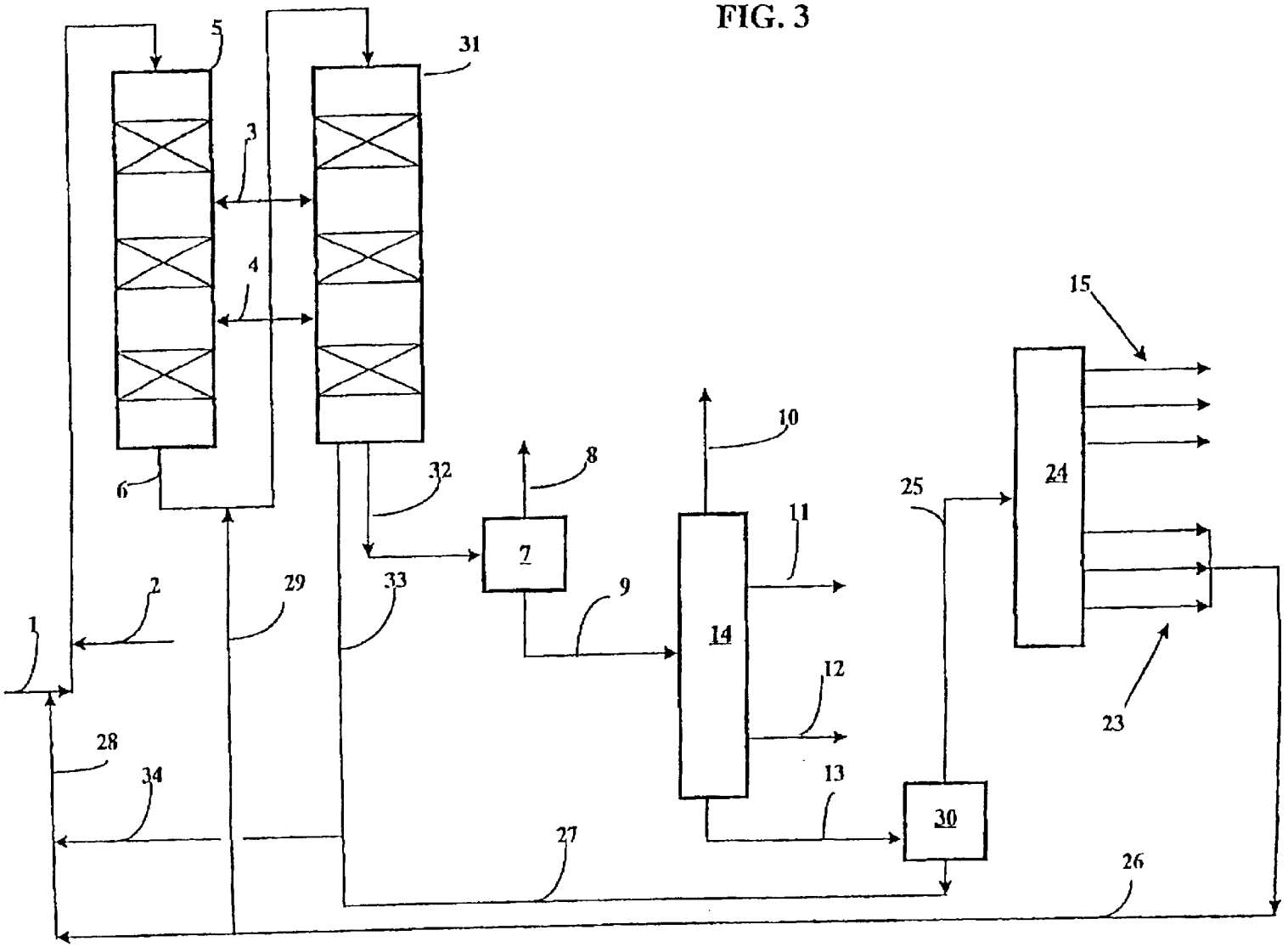

FIG. 3 differs from FIG. 2 in the presence of a second reactor 31 located at the outlet from the first reactor 5, containing a zeolite-based catalyst and the required hydrogen fed via lines 3 and 4, also in recycling low viscosity index fractions to the first and second reactors. The fractions extracted via lines 20 to 23 are recycled to the reaction system via line 26. Recycling to the first reactor 5 is via line 28, and to the second reactor 31 via line 29. Further, the paraffins from dewaxing are recycled to the first reactor 5 via line 34 and to the second reactor 31 via line 33.

The effluent leaving the first reactor via line 6 is directed to the second reactor 31 containing the hydrocracking catalyst. Under the operating conditions described above, the effluent from the first reactor 5 is transformed into an effluent containing essentially kerosine, gasoline, gas oil and an oily residue. The effluent from the second reactor 31 is sent via line 32 to a high pressure separator 7 after prior injection of washing water via a line not shown in the Figure. The washing water containing ammonia and a portion of the hydrogen sulphide in solution is evacuated from the separator via a line which is not shown in the figure. The gases from the high pressure separator 7 contain a large amount of hydrogen and are evacuated via line 8 after optional washing to eliminate the hydrogen sulphide, via a line which is not shown in the figure. Said gases also contain light hydrocarbons containing 1 to 4 carbon atoms in their molecule and are evacuated via line 8. Said hydrocarbons can then be used in the fuel-gas system after separation with hydrogen.

The liquid effluent from high pressure separator 7 is sent via line 9 to a fractionation apparatus 14. The subsequent steps are identical to those of FIG. 2.

Figure 4:
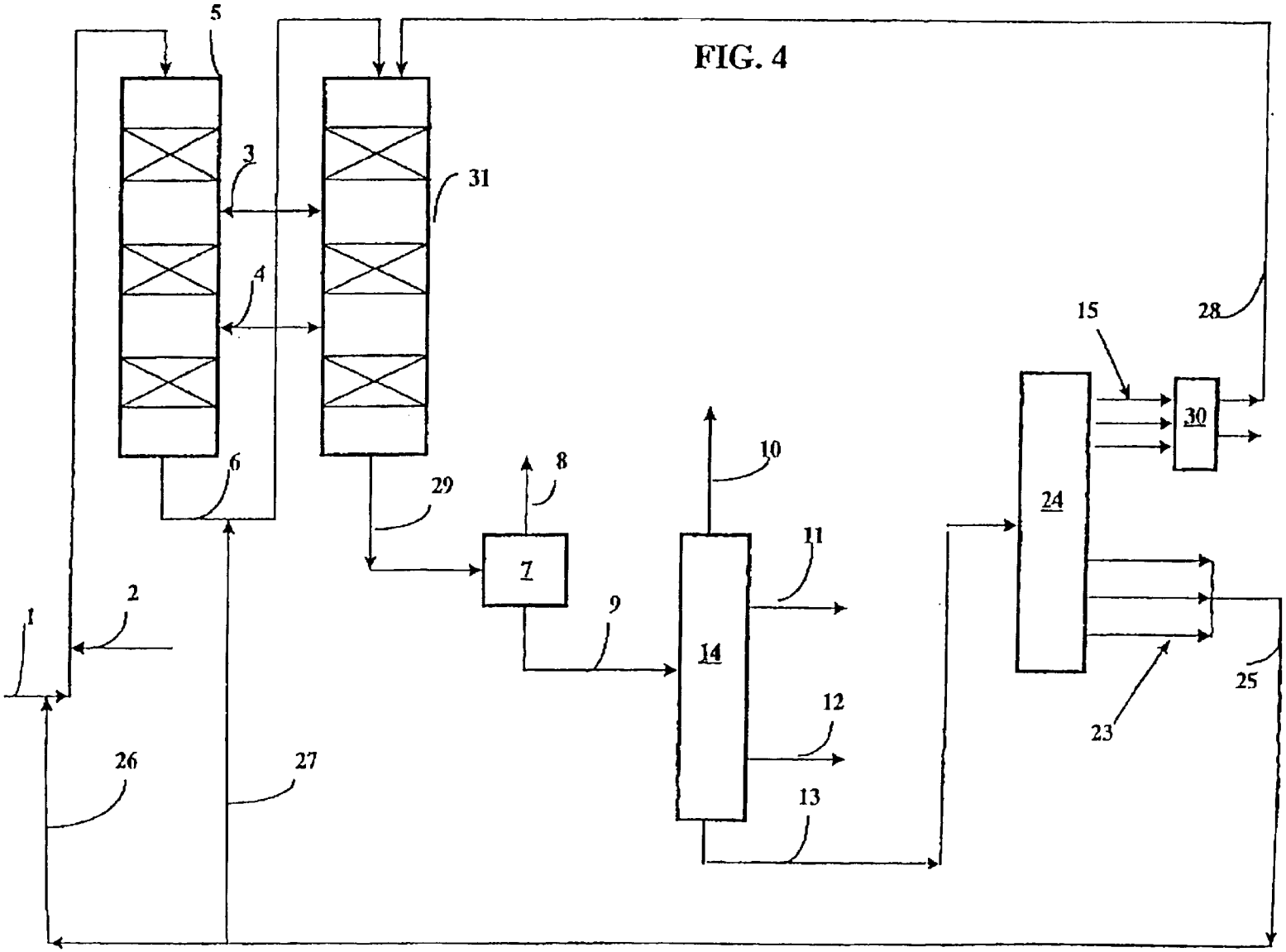

The process illustrated in FIG. 4 is carried out in identical manner to that of FIG. 3, but dewaxing apparatus 30 is located at the outlet from thermal diffusion column 24 and the paraffins obtained from dewaxing are recycled to the second reactor via line 28.

The following examples illustrate the invention without limiting its scope.

EXAMPLE 1

The implementation shown in FIG. 2 was employed. The feed was a petroleum distillate. Its characteristics are shown in Table 1.

The feed was sent to a reactor containing a catalyst, in the presence of hydrogen. Said catalyst was in the form of 1.6 millimetre (mm) diameter extrudates and was based on molybdenum a (15% $MoO_3$), nickel (5% NiO), on a γ alumina support (80% $Al_2O_3$). The reactor was heated to a temperature of about 390° C. The hourly space velocity was about 0.5 $h^{-1}$. The partial pressure of hydrogen was 14.8 MPa and the $H_2$/HC ratio was 1600 $Nm^3/m^3$.

Under these conditions, the conversion of 375° C. was about 42.7% by weight. This conversion was defined as the ratio between the weight fraction of the effluent with a boiling point of less than 375° C. minus the fraction of the feed with a boiling point less than 375° C., over the fraction of the feed with a boiling point of more than 375° C. The feed was then converted into an effluent containing essentially kerosine, gasoline, gas oil and oils.

The effluent from the reactor was sent to a high pressure separator for fractionation into a gaseous effluent containing hydrogen sulphide and hydrogen, ammonia, and light hydrocarbons which was evacuated, and into a liquid effluent which was directed towards the distillation column. Different fractions from the head to the bottom of the column were recovered as follows: a gasoline fraction, a kerosine fraction, a gas oil fraction and an oil residue from the column bottom.

The oil residue was dewaxed using methyl-isobutyl-ketone as the solvent. It was then analysed. The paraffins from dewaxing were recycled to the reactor. The characteristics of the feed and of the residue obtained after solvent dewaxing are shown in Table 1 below:

TABLE 1

| Characteristics | Feed | Residue |
|---|---|---|
| Density at 15° C. (kg/m$^3$) | 969.0 | 879.0 |
| Refractive index at 20° C. | 1.5474 | 1.4835 |
| Kinematic viscosity at 40° C. (mm$^2$/s) | 250 | 72.41 |
| Kinematic viscosity at 100° C. (mm$^2$/s) | 15.13 | 9.03 |
| Viscosity index | 34 | 98 |
| Pour point (° C.) | −27 | −21 |
| $C_a$ (%) | 29.3 | 4.84 |
| $C_p$ (%) | 60.5 | 71.59 |
| $C_n$ (%) | 10.2 | 23.57 |

$C_a$, $C_p$ and $C_n$ are respectively the percentages of aromatic, paraffinic and naphthenic hydrocarbons.

The viscosimetric qualities of the feed and residue are very different. Since conversion is limited, the viscosity index is also reduced, while remaining in accordance with current customs specifications.

Further, the different steps permitted hydrogenation of the aromatic compounds and naphthenic ring opening, resulting in a reduction in the density and an increase in the viscosity index of the oil residues, with respect to the initial feed.

A portion of the residue then circulated in the thermal diffusion column, which was 2 metres (m) high and comprised two tubes placed one inside the other. The oily residue circulated in the space formed by the tube walls. This space was about 0.25 millimetres (mm) wide. The temperature difference between the wall of the internal tube and the wall of the external tube was about 130° C.

The thermal diffusion column had 9 extraction lines to recover residue fractions. The characteristics of these fractions are shown in Table 2:

TABLE 2

| Fraction number | Density at 15° C. (kg/m$^3$) | Viscosity index | $C_a$ (%) | $C_p$ (%) | $C_n$ (%) |
|---|---|---|---|---|---|
| 1 | 828.9 | 168 | 1.6 | 96.7 | 1.7 |
| 2 | 837.8 | 147 | 2.0 | 86.3 | 11.6 |
| 3 | 849.4 | 140 | 2.6 | 75.6 | 21.8 |
| 4 | 857.7 | 127 | 2.9 | 69.5 | 27.6 |
| 5 | 876.2 | 103 | 3.7 | 55.4 | 40.8 |
| 6 | 892.5 | 76 | 4.5 | 47.5 | 48 |
| 7 | 907.0 | 53 | 5.5 | 49.1 | 45.4 |
| 8 | 922.7 | 25 | 6.7 | 45.2 | 48.1 |
| 9 | 942.2 | −24 | 8.9 | 43.1 | 48 |

$C_a$, $C_p$ and $C_n$ are respectively the percentages of aromatic, paraffinic and naphthenic hydrocarbons.

Thermal diffusion permitted the production of different oil fractions with different viscosity indices (from −24 to 168) from an oil residue with a viscosity index of about 98. Thus different oil compositions were obtained.

The three fractions at the column head each had a viscosity index which was 140 or more. They were depleted in aromatic carbons (with a percentage of 1.6% to 2.6%) and rich in paraffinic carbons (percentage of 76% to 97%). The column bottom fractions (fractions 6 to 9) were rich in aromatic carbons (4.5% to 8.9%) and naphthenic carbons (45% to 48%). Their viscosity indices were less than 100. These fractions were then recycled to the feed introduction point.

Depending on the refiner, fractions 4 and 5 with viscosity indices in the range 100 to 130, were either recycled or recovered.

EXAMPLE 2

The feed described in Example 1 was used but with the implementation illustrated in FIG. 3. The characteristics of the feed are shown in Table 3. The first catalytic hydrotreatment step was repeated in the first reactor containing the feed, hydrogen and a catalyst based on nickel, molybdenum and alumina, also the step for fractionation of the effluent from the first reactor.

The liquid effluent obtained at the outlet from the high pressure separator was introduced into a second reactor, in the presence of a second catalyst. The second catalyst comprised a HY zeolite characterized by 13.6% by weight of $SiO_2$, 13.49% by weight of $MoO_3$, 2.93% by weight of NiO, 5.09% by weight of $P_2O_5$ on a support of 64.89% by weight of $Al_2O_3$. The lattice parameter a of the unit cell was $24.28\times10^{-10}$ m, the sodium ion takeup capacity was 0.92, the specific surface area determined by the BET method was 600 m$^2$/g, the water vapour absorption capacity at 25° C. at a partial pressure of 2.6 torrs (346.63 Pa) was 13% by weight and the pore distribution included about 10% of the pore volume contained in pores with a diameter in the range $20\times10^{-10}$ m to $80\times10^{-10}$ m, the remainder of the pore volume being contained in pores with a diameter of less than $20\times10^{-10}$ m.

The operation conditions in the second reactor were identical to those in the first reactor (see Example 1).

Under these conditions, 375-° C. conversion was about 79.9% by weight. The effluent at the outlet from the second reactor was sent to a high pressure separator. The effluent was then fractionated into a gaseous effluent which was evacuated and into a liquid effluent.

The liquid effluent originated from the distillation column. A gasoline fraction, a kerosine fraction, a gas oil fraction and an oil residue were recovered, going from top to bottom.

The residue was dewaxed using methyl-isobutyl-ketone as the solvent. Its characteristics are shown in Table 4 below. The paraffins from dewaxing were partially recycled to the two reactors.

TABLE 3

| Characteristics | Feed | Residue |
|---|---|---|
| Density at 15° C. (kg/m$^3$) | 969.0 | 847.9 |
| Refractive index at 20° C. | 1.5474 | 1.4687 |
| Kinematic viscosity at 40° C. (mm$^2$/s) | 250 | 35.51 |
| Kinematic viscosity at 100° C. (mm$^2$/s) | 15.13 | 6.31 |
| Viscosity index | 34 | 129 |
| Pour point (° C.) | −27 | −21 |
| $C_a$ (%) | 29.3 | 2.80 |
| $C_p$ (%) | 60.5 | 84.79 |
| $C_n$ (%) | 10.2 | 12.41 |

$C_a$, $C_p$ and $C_n$ are respectively the percentages of aromatic, paraffinic and naphthenic hydrocarbons.

The viscosity index of the oil residue (129) after passage through the two successive reactors was higher than that of the feed (34) but it was even higher than that of the residue after passage through a single reactor (98, see Example 1). This was also the case for the paraffinic carbons.

A portion of the oil residue was sent to the thermal diffusion column with identical characteristics and operating conditions as those described for Example 1.

Separation by thermal diffusion of the oil residue into nine fractions produced the results shown in Table 4:

TABLE 4

| Fraction number | Density at 15° C. (kg/m³) | Viscosity index | $C_a$ (%) | $C_p$ (%) | $C_n$ (%) |
|---|---|---|---|---|---|
| 1 | 818.9 | 205 | 0.7 | 93.2 | 6.1 |
| 2 | 824.3 | 182 | 0.7 | 92.8 | 6.5 |
| 3 | 829.4 | 162 | 0.8 | 79.7 | 19.8 |
| 4 | 833.1 | 154 | 0.9 | 77.1 | 22.0 |
| 5 | 842.4 | 128 | 0.9 | 64.4 | 34.7 |
| 6 | 852.8 | 122 | 1.1 | 63.5 | 35.4 |
| 7 | 865.2 | 100 | 1.5 | 59.4 | 39.1 |
| 8 | 881.1 | 81 | 2.2 | 54.8 | 43.0 |
| 9 | 918.4 | 55 | 6.4 | 50.9 | 42.7 |

The viscosity indices were higher than those obtained by operating as described in Example 1. It was possible to recover oil fractions 1 to 4 with viscosity indices in the range 150 to 205 and fractions 5 and 6 with indices in the range 120 to 130. Fractions 7 to 9 were recycled to the feed introduction level.

What is claimed is:

1. A process for producing oils with a high viscosity index from a feed containing constituents with boiling points of more than about 300° C. comprising a) reacting hydrogen with the feed or with a mixture of the feed with at least a fraction of a stream recycled from c), in the presence of a catalyst comprising at least one amorphous non zeolitic matrix and at least one metal or compound of a metal from group VIII of the periodic table and/or at least one metal from group VIB to produce an effluent;

b) fractionating at least a portion of the liquid effluent obtained from a) so as to separate at least one oil residue comprising mainly constituents with viscosity indices which are higher than that of the feed;

c) fractionating at least a portion of the oil residue obtained in b) by thermal diffusion into oil fractions with high viscosity indices and separating the oil fractions in accordance with their viscosity index, and recycling at least part of at least one fraction with low viscosity index from c) to a).

2. A process according to claim 1, in which b) is preceded by a d) for bringing at least a portion of the effluent obtained in a) into contact with hydrogen in the presence of a catalyst comprising at least one zeolite, at least one matrix, and at least one metal or compound of a metal from group VIII of the periodic table and/or least one group VIB metal, the effluent obtained from d) being sent to c).

3. A process according to claim 2, in which at least a portion of unconverted fractions recovered in a) or d) are recycled either to a) or to d) or partially to both a) and d).

4. A process according to claim 2, in which recycle streams from c) comprising fractions from c) with low viscosity indices, are recycled at least partially to both a) and d).

5. A process according to claim 3, in which oil residue obtained in b) and/or non-recycled fractions extracted from c) are dewaxed with a catalyst or a solvent, the paraffins from this dewaxing step being recycled either to a) or to d) or partially to both a) and d).

6. A process according to claim 1, in which matrix for the catalyst of a) as selected from group consistent by alumina, silica, silica-aluminas, magnesia, clays and mixtures of at least two of said minerals.

7. A process according to claim 1, in which the catalyst of a) comprises a total concentration of oxides of metals from group VIB and VIII in the range of about 5% to 40% by weight, with a ratio between the metal (or metals) from group VIB and the metal (or metals) from group VIII, expressed as the metal oxides, of about 20 to 1 by weight.

8. A process according to claim 2, in which the zeolite for the catalyst of d) is an acid zeolite HY characterized by a $SiO_2/Al_2O_3$ mole ratio in the range about 8 to 70; a sodium content which is less than about 0.15% by weight, determined using the zeolite calcined at 1100° C.; a lattice parameter a of the unit cell in the range about $24.55\times10^{-10}$ metres (m) to 24.24 $10^{-10}$ m; a sodium ion take-up capacity $C_{Na}$, expressed as grams (g) of sodium per 100 g of modified zeolite, neutralised then calcined, of more than about 0.85; a specific surface area, determined by the BET method, of more than about 400 $m^2/g$; a water vapour adsorption capacity at 25° C. at a partial pressure of 2.6 torrs of more than about 6% by weight, a pore distribution with in the range about 1% to 20% of the pore volume contained in pores with a diameter located between about $20\times10^{-10}$ metres and $80\times10^{-10}$ metres, the remainder of the pore volume being contained in pores with a diameter of less than $20\times10^{-10}$ metres, and a zeolite mass in the range of 2% to 80% with respect to the catalyst used in d).

9. A process according to claim 2, in which matrix for the catalyst of d) is selected from group consisting of alumina, silica, silica-aluminas, alumina-boron oxide, magnesia, silica-magnesia, zirconia, titanium oxide and clay, these compounds being used alone or as a mixture.

10. A process according to claim 2, in which the catalyst of d) comprises a total concentration of oxides of metals from group VIB and VIII in the range fro abut 1% to 40% by weight, the ratio between the group VIB metal or metals and the group VIII metal or metals, expressed as the metal oxides, being the range about 20 to 1.25 by weight, and the concentration of phosphorous oxides being less than about 15% by weight.

11. A process according to claim 2, in which a) and d) are carried out at an absolute pressure in the range about 2 to 35 MPa, a temperature in the range about 300° C. to 550° C., a hourly space velocity in the range bout 0.01 to 10 $h^{-1}$, in the presence of hydrogen, the $H_2$/HC ratio being in the range about 50 to 5000 $Nm^3/m^3$, the conditions for a) and d) being identical or different.

12. A process according to claim 1, in which c) of the process is carried out in at lease one thermal diffusion column with a height in the range about 0.5 to 30 metres (m), comprising two tubes placed one inside the other, the oily residue circulating in the space formed by said two tubes, the space between said two tubes being in the range from about 1 millimetre (mm) to 20 centimetres (cm); the temperature difference between the wall of the internal tube an the wall of the external tube being in the range bout 25° C. to 300° C., the wall of the internal tube being kept at a temperature which is les than that of the wall of the external tube.

13. A process according to claim 8, in which the catalyst of a) comprises a total concentration of oxides of metals from groups VIB and VIII in the range of about 5% to 40% by weight, with a ratio between the metal from group VIB and the metal from group VIII, expressed as metal oxides, of about 20 to 1 by weight.

14. A process according to claim 8, in which the matrix of the catalyst for d) is selected from the group consisting of alumina, silica, silica-alumina, alumina-boron oxide, magnesia, silica-magnesia, zirconia, titanium oxide and clay, these compounds being used alone or as a mixture.

15. A process according to claim 8, in which the catalyst for d) comprises a total concentration of oxides of metals from groups VIB and VIII in the range from about 1% to 40% by weight, the ratio between the group VIB metal and the group VIII metal expressed as metal oxides, being in the range about 20 to 1.25 by weight, and a concentration of phosphorous oxides being less than about 15% by weight.

16. A process according to claim 14, in which the catalyst for d) comprises a total concentration of oxides of metals from groups VIB and VIII in the range from about 1% to 40% by weight, the ratio between the group VIB metal and the group VIII metal expressed as metal oxides, being in the range about 20 to 1.25 by weight, and the concentration of phosphorous oxides being less than about 15% by weight.

17. A process according to claim 5, in which dewaxing is conducted in the presence of a molecular sieve having a bridging distance at most 0.75 Nm.

18. A process according to claim 5, in which dewaxing is conducted in the presence of a molecular sieve having a bridging distance of to 0.50 to 0.75 Nm.

19. A process according to claim 2, further comprising a) fractionating the effluent obtained from a) or d) in at least one separator, into at least one gaseous effluent, which is evacuated and into at least one liquid effluent which is sent to b).

20. A process for producing oils with a high viscosity index from a feed containing constituents with boiling points of more than about 300° C. comprising a) reacting hydrogen with the feed or with a mixture of the feed with at least a fraction of a stream recycled from c), in the presence of a catalyst comprising at least one amorphous non zeolite matrix and at least one metal or compound of a metal from group VIII of the periodic table and/or at least one metal from group VIB to produce an effluent;

b) fractionating at least a portion of the liquid effluent obtained from a) so as to separate at least one oil residue comprising mainly constituents with viscosity indices, which are higher than that of the feed;

c) fractionating at least a portion of the oil residue obtained in step b) by thermal diffusion into oil fractions with high viscosity indices, and separating the oil fractions in accordance with their viscosity index with proviso that b) is not preceded by treatment of the effluent of a) with hydrogen in the presence of a zeolite.

* * * * *